US007202843B2

(12) United States Patent
Shen et al.

(10) Patent No.: US 7,202,843 B2
(45) Date of Patent: Apr. 10, 2007

(54) DRIVING CIRCUIT OF A LIQUID CRYSTAL DISPLAY PANEL AND RELATED DRIVING METHOD

(75) Inventors: Yung-Hung Shen, Hsin-Chu (TW); Shih-Chung Wang, Kao-Hsiung (TW); Yuh-Ren Shen, Tai-Nan (TW); Cheng-Jung Chen, Miao-Li Hsien (TW)

(73) Assignee: Vastview Technology Inc., Hsin-Chu (TW)

( * ) Notice: Subject to any disclaimer, the term of this patent is extended or adjusted under 35 U.S.C. 154(b) by 602 days.

(21) Appl. No.: 10/707,741

(22) Filed: Jan. 8, 2004

(65) Prior Publication Data

US 2005/0104824 A1 May 19, 2005

(30) Foreign Application Priority Data

Nov. 17, 2003 (TW) ..... 92132122 A

(51) Int. Cl.
*G09G 3/36* (2006.01)

(52) U.S. Cl. ..... 345/87; 345/89

(58) Field of Classification Search ..... 345/87, 345/88, 89, 90, 91, 93, 98, 99, 100, 204, 345/589, 596, 600–605
See application file for complete search history.

(56) References Cited

U.S. PATENT DOCUMENTS

2001/0038372 A1* 11/2001 Lee ..... 345/89
2002/0044115 A1 4/2002 Jinda et al.
2003/0058264 A1 3/2003 Takako et al.
2004/0119730 A1* 6/2004 Ham et al. ..... 345/692
2004/0196229 A1* 10/2004 Ham ..... 345/87
2004/0246224 A1* 12/2004 Tsai et al. ..... 345/100
2005/0073630 A1* 4/2005 Chen et al. ..... 349/87

FOREIGN PATENT DOCUMENTS

EP 0539185 A1 4/1993
EP 0660297 A2 6/1995
EP 0660297 A3 6/1995
EP 1122711 A2 8/2001
EP 1122711 A3 8/2001

OTHER PUBLICATIONS

Baek-Woon Lee, et al.; Reducing Gray-Level Response to One Frame: Dynamic Capacitance compensation; Samsung Electronics Corp.; ISSN00010966X, 2001.

* cited by examiner

*Primary Examiner*—Nitin Patel
(74) *Attorney, Agent, or Firm*—Winston Hsu

(57) ABSTRACT

A method for driving a liquid crystal display (LCD) panel includes receiving continuously a plurality of frame data, generating a plurality of data impulses for each pixel every frame period according to the frame data, and applying the data impulses to a liquid crystal device of a pixel within a frame period via the data line connected to the pixel in order to control a transmission rate of the liquid crystal device.

9 Claims, 10 Drawing Sheets

DRIVING CIRCUIT OF A LIQUID CRYSTAL DISPLAY PANEL AND RELATED DRIVING METHOD

BACKGROUND OF INVENTION

1. Field of the Invention

The invention relates to a driving circuit of a liquid crystal display (LCD) panel and its related driving method, and more particularly, to a driving circuit for applying over two data impulses to a pixel electrode within one frame period, and its related driving method.

2. Description of the Prior Art

A liquid crystal display (LCD) has advantages of light-weight, low power consumption, and low divergence and is applied to various portable equipment such as notebook computers and personal digital assistants (PDAs). In addition, LCD monitors and LCD televisions are gaining in popularity as a substitute for traditional cathode ray tube (CRT) monitors and televisions. However, an LCD does have some disadvantages. Because of the limitations of physical characteristics, the liquid crystal molecules need to be twisted and rearranged when changing input data, which can cause the images to be delayed. For satisfying the rapid switching requirements of multimedia equipment, improving the response speed of liquid crystal is desired.

Generally when driving an LCD, a driving circuit receives a plurality of frame data and then generates corresponding data impulses, scan voltages, and timing signals, according to the frame data, in order to control pixel operation of the LCD. Each of the frame data includes data for refreshing all of the pixels within a frame period; thus each of the frame data can be regarded as including a plurality of pixel data, and each of the pixel data is for defining the gray level that a pixel is required to reach within a frame period. In the general standard, each pixel can switch among 256 ($2^8$) gray levels, thus each of the pixel data is 8 bits in length.

Please refer to FIG. 1 showing a timing diagram of pixel data values varying in accordance with the frames. When driving a pixel, the driving circuit receives a plurality of pixel data used for driving the pixel in sequence. As shown in FIG. 1, GN, GN+1, GN+2 are the pixel data received in frame periods N, N+1, N+2, and the driving circuit determines the gray level of the pixel in the frame periods N, N+1, N+2 according to the values of the pixel data GN, GN+1, GN+2. In general, the larger the value of the pixel data is, the larger the gray level is. The driving circuit generates a data impulse corresponding to a frame period according to the pixel data GN, GN+1, GN+2, and applies the pulse to a pixel electrode of the corresponding pixel to have the pixel be in the appropriate gray level as required within each frame period.

Please refer to FIG. 2 showing a timing diagram of different transmission rates of a pixel, varying in accordance with the frames. Two curves C1, C2 are measured when the driving circuit changes the transmission rate from T1 to T2 beginning at frame period N. The curve C1 shows the transmission rate of a pixel not overdriven corresponding to the frames, and the curve C2 shows the transmission rate of the pixel overdriven corresponding to the frames. The U.S. published application No. 2002/0050965 is one of the references of the conventional overdriving method. There is a time delay when charging liquid crystal molecules, so that they cannot twist at a predetermined angle at a predetermined transmission rate. As shown by the curve C1, in the case of not being overdriven, the transmission rate cannot reach a predetermined level in the frame period N but has to wait until the frame period N+2. Such a delay causes blurring. In order to improve that, some conventional LCD are overdriven, which means applying a higher or a lower data impulse to the pixel electrode to accelerate the reaction speed of the liquid crystal molecules, so that the pixel can reach the predetermined gray level in a predetermined frame period. As shown by the curve C2, in the case of being overdriven, although the reaction speed of the liquid crystal molecules is faster than in case of not being overdriven, the transmission rate has to wait until frame period N+1 to reach T2. Thus, the requirement of reaching T2 in the frame period N still remains unsatisfied.

SUMMARY OF INVENTION

It is therefore a primary objective of the claimed invention to provide a driving circuit of an LCD panel and its relating driving method to solve the problem mentioned above.

Briefly, the present invention provides a method for driving an LCD panel. The LCD panel includes a plurality of scan lines, a plurality of data lines, and a plurality of pixels. Each pixel is connected to a corresponding scan line and a corresponding data line, and each pixel includes a liquid crystal device and a switching device connected to the corresponding scan line, the corresponding data line, and the liquid crystal device. The method includes receiving continuously a plurality of frame data, generating a plurality of data impulses for each pixel in every frame period according to the frame data and applying the data impulses to the liquid crystal device of one of the pixels within one frame period via the data line connected to the pixel in order to control the transmission rate of the liquid crystal device of the pixel.

The present invention further provides a driving circuit for driving an LCD panel including a blur clear converter for receiving frame data every frame period, each frame data comprising a plurality of pixel data and each pixel data corresponding to a pixel, the blur clear converter delaying current frame data to generate delayed frame data and generating a plurality of overdriven pixel data in every frame period for each pixel; a source driver for generating a plurality of data impulses to each pixel according to the plurality of overdriven pixel data generated by the blur clear converter and applying the data impulses to the liquid crystal device of the pixel via the scan line connected to the pixel in order to control the transmission rate of the liquid crystal device; and a gate driver for applying a scan line voltage to the switch device of the pixel so that the data impulses can be applied to the liquid crystal device of the pixel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
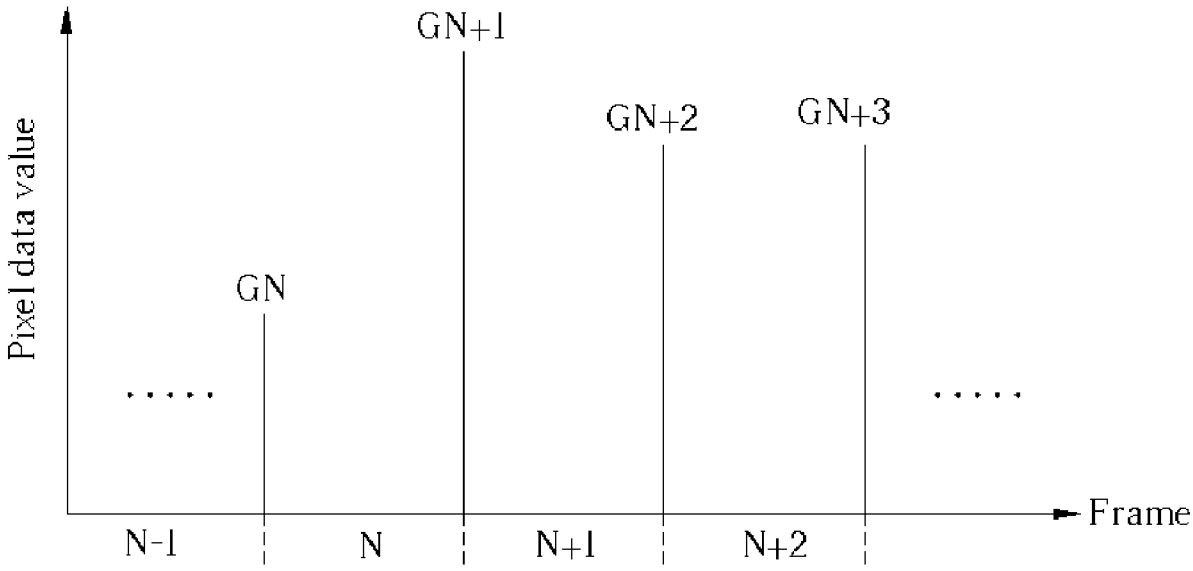
Fig. 1 Prior art
FIG. 1 is a timing diagram of the pixel data values varying in accordance with the frames according to the prior art.
Figure 2:
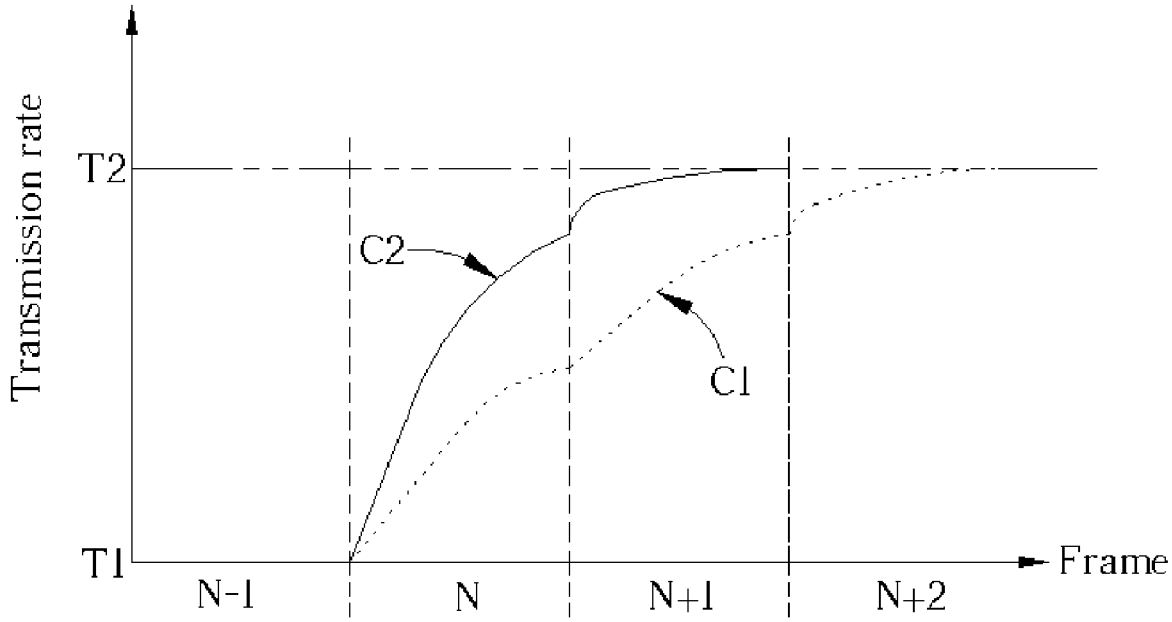
Fig. 2 Prior art
FIG. 2 is a timing diagram of different transmission rates of the pixel varying in accordance with the frames.
Figure 3:
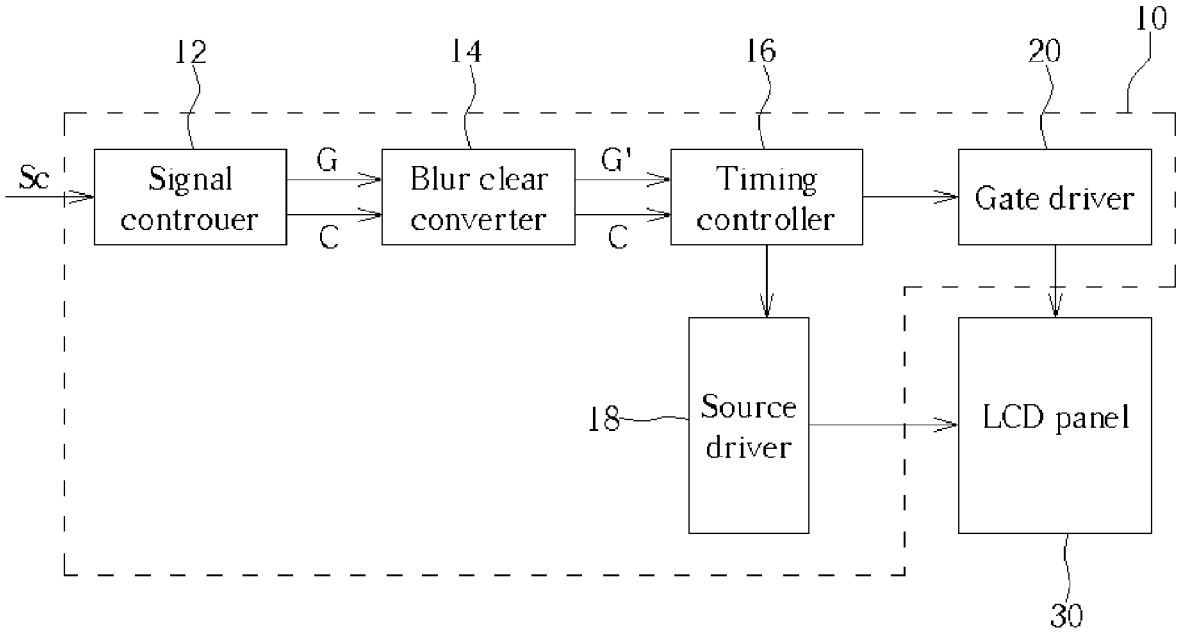
FIG. 3 is a block diagram of a driving circuit and an LCD panel according to the present invention.

Please refer to FIG. 3 showing a block diagram of a driving circuit 10 and an LCD panel 30 according to the present invention. The driving circuit 10 is for driving the LCD panel 30, which includes a signal controller 12, a blur clear converter 14, a timing controller 16, a source driver 18, and a gate driver 20. The signal controller 12 is for receiving composite video signals Sc, which includes frame data and timing data for driving the LCD panel 30, and processing the composite video signals Sc to separate them into frame signals G and control signals C. Subsequently, the blur clear converter 14 continuously receives the control signals C and the frame data included in the frame signals G and generates processed frame signals G including a plurality of overdriven data according to the frame data. The timing controller 16 controls the source driver 18 and the gate driver 20 according to the frame signals G and the control signals C so that the source driver 18 and the gate driver 20 generate corresponding data line voltages and scan line voltages according to the plurality of overdriven data included in the frame signals G in order to drive the LCD panel 30 to generate images corresponding to the composite video signals Sc.

Figure 4:
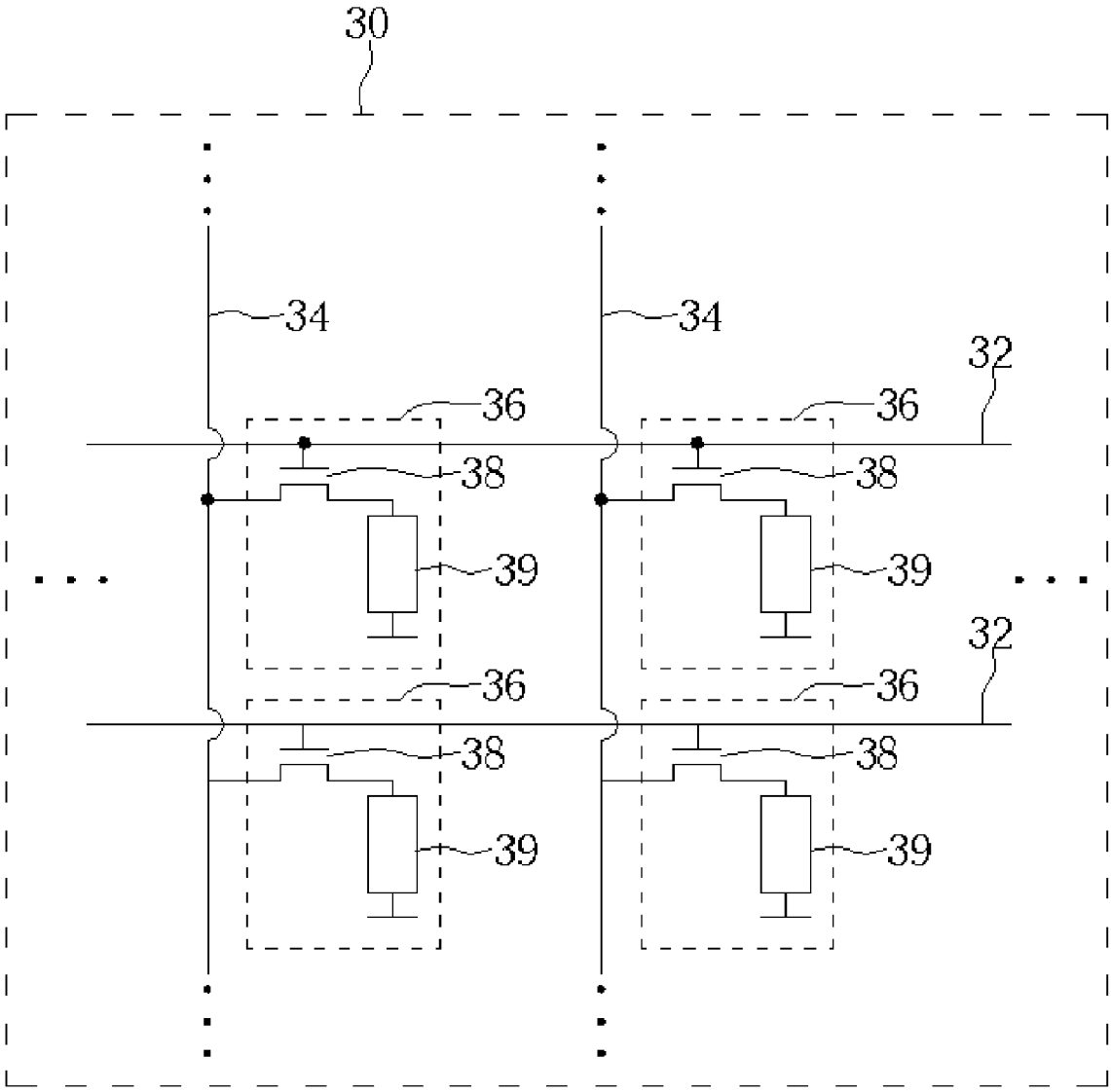
FIG. 4 is a circuit diagram of the LCD panel.

Please refer to FIG. 4 showing a circuit diagram of the LCD panel 30. The LCD panel 30 includes a plurality of scan lines 32, a plurality of data lines 34, and a plurality of pixels 36. Each pixel 36 is connected to a corresponding scan line 32 and a corresponding data line 34, and each pixel 36 has a switching device 38 and a liquid crystal device 39 a.k.a. a pixel electrode. The switching device 38 is connected to the corresponding scan line 32 and the corresponding data line 34, and the source driver 18 and the gate driver 20 control the operation of each pixel 36 via the scan line 32 and the data line 34. To drive the LCD 30, scan voltages are applied to the scan lines 32 to turn on the switching devices 38, and data voltages are applied to the data lines 34 and transmitted to the pixel electrodes 30 through the switching devices 38. Therefore, when the scan voltages are applied to the scan lines 32 to turn on the switching devices 38, the data voltages on the data lines 34 will charge the pixel electrodes 39 through the switch devices 38, thereby twisting the liquid crystal molecules. When the scan voltages on the scan lines 32 are removed to turn off the switching devices 38, the data lines 34 and the pixels 36 will disconnect, and the pixel electrodes 39 will remain charged. The scan lines 32 turn the switching devices 38 on and off repeatedly so that the pixel electrodes 39 can be repeatedly charged. Different data voltages cause different twisting angles and show different transmission rates. Hence, the LCD 30 displays various images.

Figure 5:
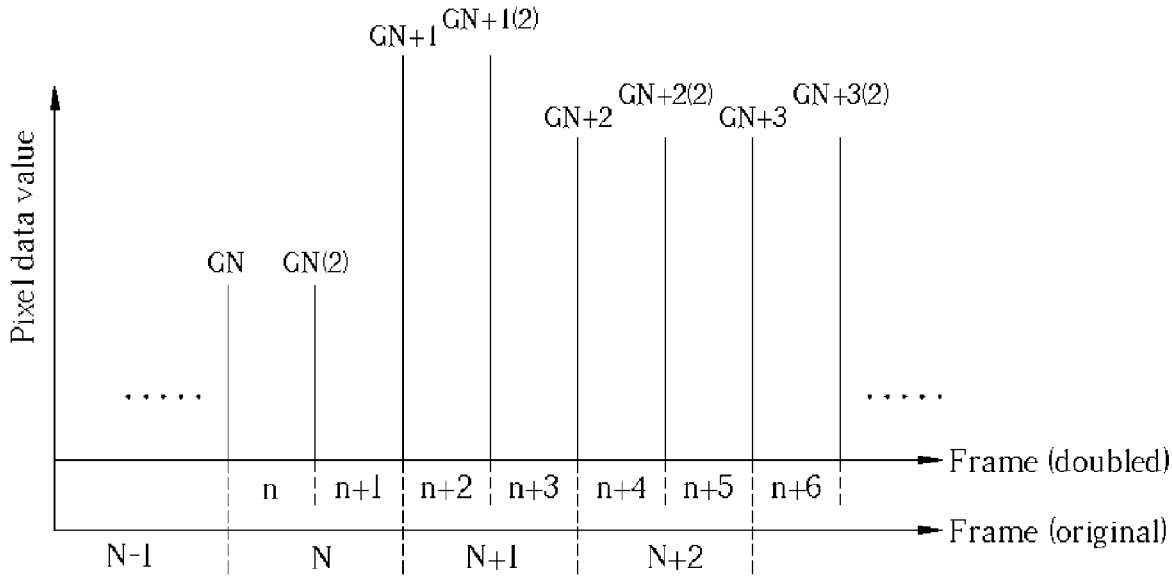
FIG. 5 is a timing diagram of pixel data values varying in accordance with frames.

Please refer to FIG. 5 showing a timing diagram of pixel data values varying in accordance with frames. According to the present invention, when driving any pixel 36 of the LCD panel 30, the driving circuit 10 generates a plurality of pixel data used for driving the pixel in sequence. As shown in FIG. 5, GN, GN(2), GN+1, GN+1(2), GN+2, GN+2(2), GN+3, GN+3(2) are the pixel data generated in frame periods N, N+1, N+2, N+3. The driving circuit 10 generates two pieces of pixel data for each pixel 36 in every frame period. The driving circuit 10 drives the pixel to reach gray levels in the frame periods N, N+1, N+2, N+3 according to the values of the pixel data GN–GN+2(2). For instance, when the pixel data GN, GN(2) are generated, the source driver of the driving circuit 10 converts the pixel data GN, GN(2) into two corresponding data impulses and then applies them to the liquid crystal device 39 via the data line 32 in the frame period N in order to control the transmission rate of the liquid crystal device 39. Similarly, data impulses corresponding to the pixel data GN+1–GN+3(2) are applied respectively to corresponding pixel electrodes 39 every half a frame period. Same as the prior art, the larger the value of the pixel data is, the higher the voltage of the corresponding data impulse is, and the larger the gray level value is.

Figure 6:
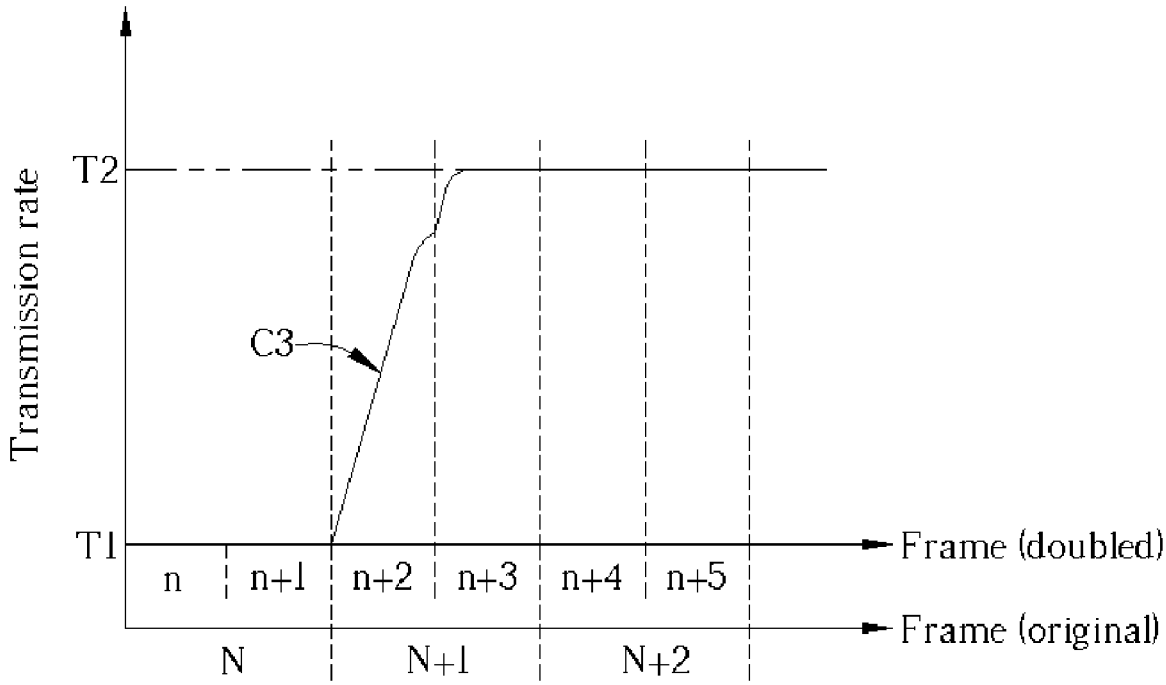
FIG. 6 is a timing diagram of the transmission rate of the pixel varying in accordance with the frames.

Please refer to FIG. 6 showing a timing diagram of the transmission rate of the pixel 36 varying in accordance with the frames. As described above, the driving circuit 10 generates two pieces of pixel data in each frame period, and then the source driver 18 generates two corresponding data impulses according to the two pieces of pixel data and applies them to the pixel electrode 39 of the corresponding pixel 36 in order to control the transmission rate and gray level of the pixel electrode 39. As shown in FIG. 6, the driving circuit 10 changes the transmission rate of the pixel electrode 39 of a pixel 36 from T1 to T2 in the frame period N+1. The pixel electrode 39 is applied with two data impulses corresponding to the pixel data GN+1, GN+1(2) in the frame period N+1 at a time interval of half a frame period. As shown in FIG. 6, although the transmission rate of the pixel electrode 39 cannot reach T2 in the first half period n+2 of the frame period N+1, in the later half period n+3 of the frame period N+1, the pixel electrode 39 is applied with another data impulse, so that the transmission rate can reach T2 in the frame period N+1 as required. Therefore, blurring will not occur.

Figure 7:
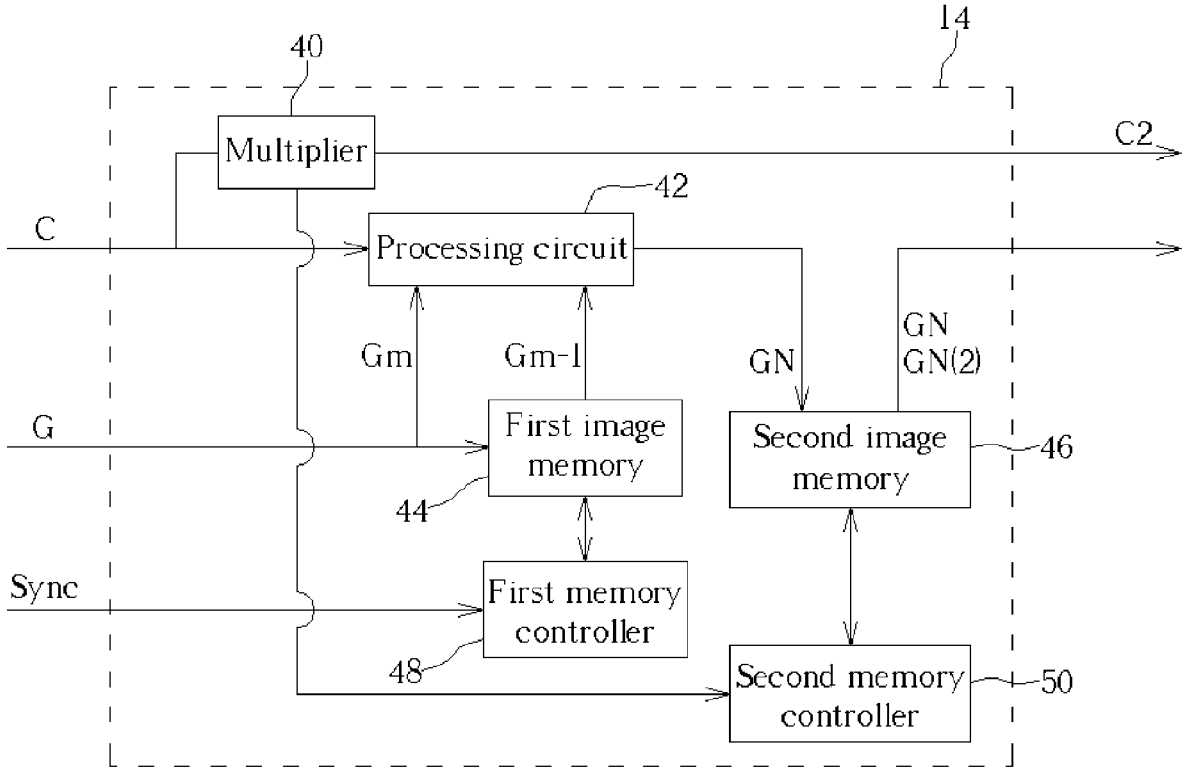
FIG. 7 is a block diagram of the blur clear converter according to the first embodiment of the present invention.

In the present embodiment, the two pieces of pixel data of each pixel in every frame period are generated by the blur clear converter 14. Please refer to FIG. 7 showing a block diagram of the blur clear converter 14. The blur clear converter 14 includes a multiplier 40, a processing circuit 42, a first image memory 44, a second image memory 46, a first memory controller 48, and a second memory controller 50. The multiplier 40 is for doubling the frequency of the control signal C to generate a multiplied signal C2. The first image memory 44 is controlled by the first memory controller 48 to delay current pixel data Gm for a frame period to generate delayed pixel data Gm−1 according to the control signal C. The processing circuit 42 generates a plurality of overdriven pixel data GN according to the current pixel data Gm and the delayed pixel data Gm−1. The second image memory 46 stores the overdriven pixel data GN, and the second memory controller 50 controls the second image memory 46 to output two overdriven pixel data GN, GN(2) to each pixel 36 within a frame period according to the multiplied signal C2 in order to have the source driver 18 apply two data impulses to a specific pixel 36 within a frame period according to the two overdriven pixel data GN, GN(2).

Figure 8:
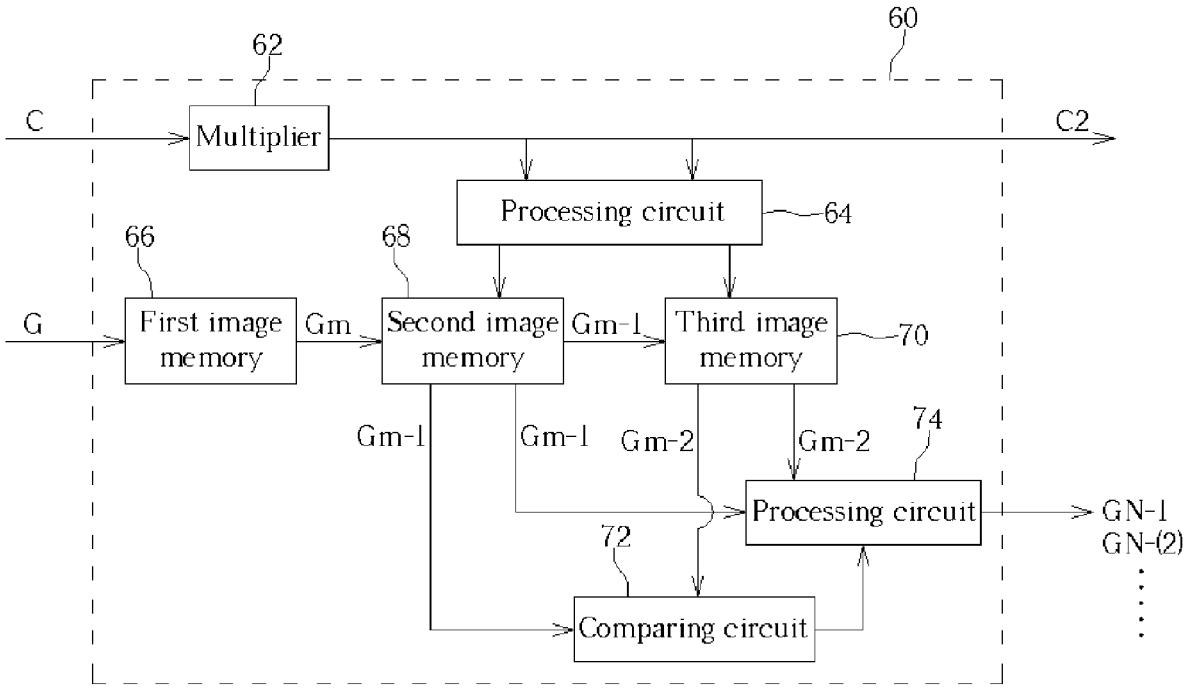
FIG. 8 is a block diagram of the blur clear converter according to the second embodiment of the present invention.

Please refer to FIG. 8 showing a block diagram of the blur clear converter 60 according to the second embodiment of the present invention. The blur clear converter 60 functions the same as the blur clear converter 14, which includes a multiplier 62, a first image memory 66, a second image memory 68, a third image memory 70, a memory controller 64, a processing circuit 74, and a comparing circuit 72. The multiplier 62 is for doubling the frequency of the control signal C to generate a multiplied signal C2. The first image memory 66 is for receiving and temporarily storing a plurality of pixel data G. The second image memory 68 delays the plurality of pixel data G for a frame period to generate delayed pixel data Gm−1. The third image memory 70 delays the pixel data Gm−1 for a frame period to generate delayed pixel data Gm−2. Thus the pixel data Gm−2 lags the pixel data Gm−1 for a frame period, and so does the pixel data Gm−1 with respect to the pixel data Gm. The memory controller 64 controls the second image memory 68 and the third image memory 70 to output two overdriven pixel data in each frame period according to the multiplied signal C2. The processing circuit 74 generates two pieces of overdriven pixel data GN1, GN−1(2) for each pixel 36 in every frame period according to the pixel data Gm−1, Gm−2. The comparing circuit 72 compares the pixel data Gm−1 with the pixel data Gm−2 to determine the values of the overdriven pixel data GN−1, GN−1(2).

Figure 9:
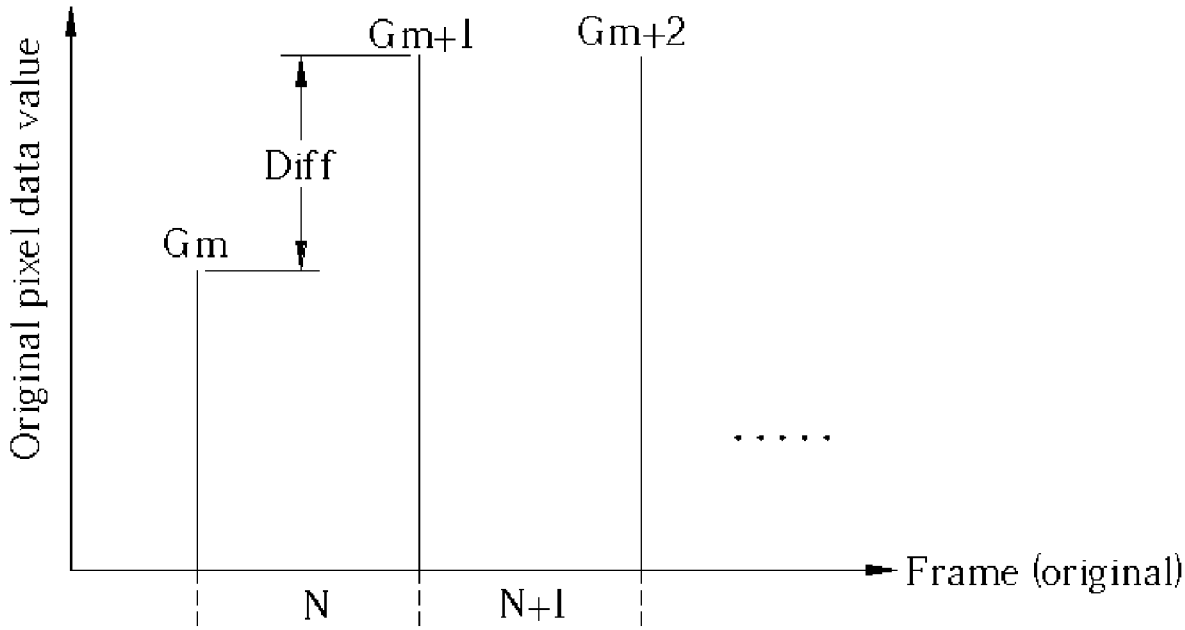
FIG. 9 is a timing diagram of original pixel data received by the blur clear converter varying in accordance with the frames.
Figure 10:
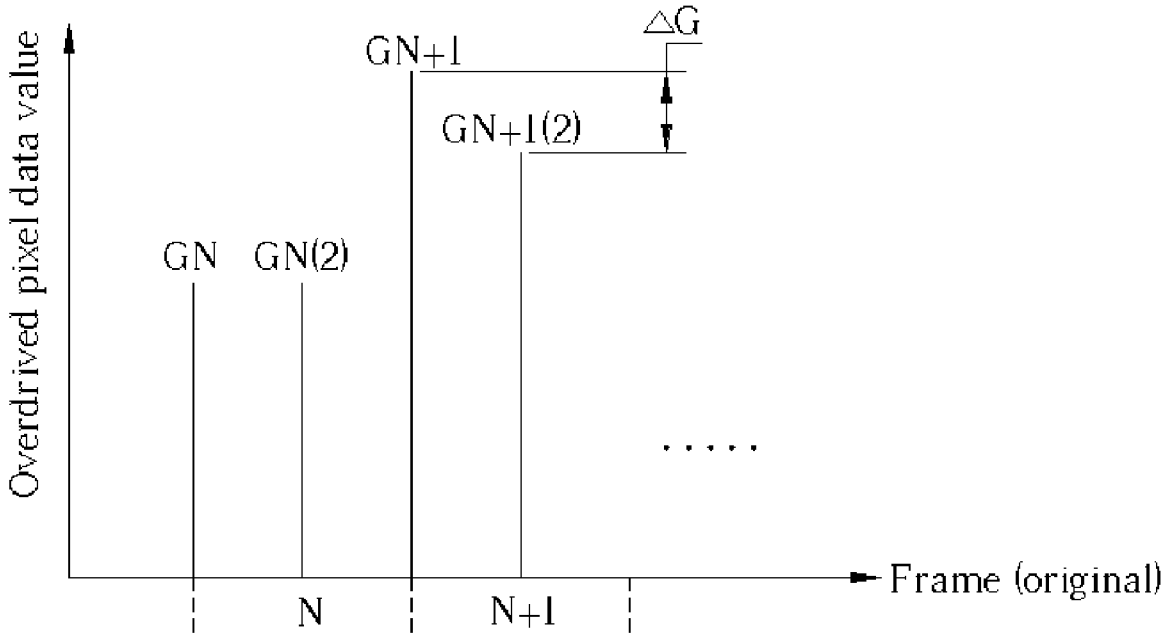
FIG. 10 is a timing diagram of overdriven pixel data generated by the blur clear converter varying in accordance with the frames.

Please refer to FIG. 9 showing a timing diagram of original pixel data received by the blur clear converter 60 varying in accordance with the frames, and FIG. 10 showing a timing diagram of overdriven pixel data generated by the blur clear converter 60 varying in accordance with the frames. As shown in FIG. 9, the original pixel data received by the blur clear converter 60 in the frame periods N and N+1 are respectively Gm and Gm+1, with a difference Diff between each other. The blur clear converter 60 generates the two overdriven pixel data GN+1, GN+1(2) with a difference ΔG between each other according to the original pixel data Gm, Gm+1. The difference ΔG is determined by the comparing circuit 72 in FIG. 8 for driving the pixels 36 according to difference conditions. The difference ΔG is determined according to the difference Diff between the original pixel data Gm and Gm+1. For instance, when the difference Diff is less than a specific value, the comparing circuit 72 determines the difference ΔG as 0, that is equating the overdriven pixel data GN+1 to the overdriven pixel data GN+1(2). Or when the difference Diff is larger than a specific value, the comparing circuit 72 modulates the difference ΔG to drive the LCD panel 30 properly.

In contrast to the prior art, the present invention discloses a driving circuit and relating driving method to generate two pieces of pixel data in each frame period for every pixel on an LCD panel and then to generate two data impulses according to the two pieces of pixel data and to apply them to each pixel within a frame period in order to change the transmission rate of a pixel electrode. Thus, each of the pixels of the LCD panel is applied of a plurality of data impulses within a frame period, so that liquid crystal molecules of the pixels can twist to reach a predetermined gray level within a frame period, and blurring will not occur.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. A driving circuit for driving an LCD panel, the LCD panel comprising:

a plurality of scan lines;

a plurality of data lines; and a plurality of pixels, each pixel being connected to a corresponding scan line and a corresponding data line, and each pixel comprising a liquid crystal device and a switching device connected to the corresponding scan line, the corresponding data line, and the liquid crystal device, the driving circuit comprising:

a blur clear converter for receiving frame data every frame period, each frame data comprising a plurality of pixel data and each pixel data corresponding to a pixel, the blur clear converter delaying current frame data to generate delayed frame data and generating a plurality of overdriven pixel data within every frame period for each pixel;

a source driver for generating a plurality of data impulses to each pixel according to the plurality of overdriven pixel data generated by the blur clear converter and applying the data impulses to the liquid crystal device of the pixel via the scan line connected to the pixel within one frame period in order to control transmission rate of the liquid crystal device; and a gate driver for applying a scan line voltage to the switch device of the pixel so that the data impulses can be applied to the liquid crystal device of the pixel.

2. The driving circuit of claim 1 wherein the blur clear converter further comprises:

a multiplier for multiplying a frequency of a control signal to generate a multiplied signal;

a first image memory for delaying the pixel data for a frame period;

a processing circuit for generating the plurality of overdriven pixel data according to the pixel data and the pixel data delayed by the first image memory;

a second image memory for storing the overdriven pixel data;

a memory controller for controlling the second image memory according to the multiplied signal to output the plurality of overdriven pixel data to any pixel so that the source driver generates the data impulses to each pixel within one frame period according to the overdriven pixel data output by the second image memory.

3. The driving circuit of claim 1 wherein the blur clear converter further comprises:

a multiplier for multiplying a frequency of a control signal to generate a multiplied signal;

a first image memory for receiving and temporarily storing the pixel data;

a second image memory for delaying the pixel data stored and output by the first image memory for a frame period;

a third image memory for delaying the pixel data stored and output by the second image memory for a frame period;

a memory controller for controlling the second image memory and the third image memory according to the multiplied signal;

a processing circuit for generating the plurality of overdriven pixel data according to the pixel data delayed and output by the second image memory and the third image memory; and a comparing circuit for comparing the pixel data delayed by the second image memory with the pixel data delayed by the third image memory in order to determine data values of the overdriven pixel data generated by the processing circuit.

4. A method for driving a liquid crystal display (LCD) panel, the LCD panel comprising:

a plurality of scan lines;

a plurality of data lines; and a plurality of pixels, each pixel being connected to a corresponding scan line and a corresponding data line, and each pixel comprising a liquid crystal device and a switching device connected to the corresponding scan line, the corresponding data line, and the liquid crystal device, and the method comprising:

receiving continuously a plurality of frame data;

generating a plurality of data impulses for each pixel within every frame period according to the frame data; and applying the data impulses to the liquid crystal device of one of the pixels within one frame period via the data line connected to the pixel in order to control a transmission rate of the liquid crystal device of the pixel.

5. The method of claim 4 further comprising:

delaying the frame data to generate a plurality of corresponding delayed frame data; and comparing current frame data and corresponding delayed data to determine voltage values of the data impulses when generating the data impulses.

6. The method of claim 5 wherein the data impulses are a first data impulse and a second data impulse applied to the liquid crystal device of the pixel in sequence within the frame period.

7. The method of claim 6 further comprising:

determining a difference between the first data impulse and the second data impulse according to the current frame data and the corresponding delayed frame data.

8. The method of claim 4 further comprising:

applying a scan line voltage to the switch device of the pixel via the scan line connected to the pixel in order to have the data impulses be applied to the liquid crystal device of the pixel.

9. The method of claim 4 wherein each frame data comprises a plurality of pixel data, and each pixel data corresponds to a pixel.

* * * * *